US005655715A

United States Patent [19]

Hans et al.

[11] Patent Number: 5,655,715

[45] Date of Patent: Aug. 12, 1997

[54] FUEL INJECTION VALVE

[75] Inventors: Waldemar Hans; Christian Preussner, both of Bamberg, Germany

[73] Assignee: Robert Bosch GmbH, Stuttgart, Germany

[21] Appl. No.: 439,229

[22] Filed: May 11, 1995

[30] Foreign Application Priority Data

May 11, 1994 [DE] Germany ..... 44 16 610.9

[51] Int. Cl.[6] ..... F02M 23/00

[52] U.S. Cl. ..... 239/408; 123/531; 239/585.1

[58] Field of Search ..... 239/408, 409, 239/533.12, 585.1, 585.4, 600

[56] References Cited

U.S. PATENT DOCUMENTS 4,957,241 9/1990 Roger .
4,982,716 1/1991 Takeda et al. .
5,360,166 11/1994 Nogi ..... 239/408

FOREIGN PATENT DOCUMENTS 41 08 279 A1 9/1991 Germany .
4129834 3/1993 Germany .

*Primary Examiner*—Robert J. Oberleitner
*Assistant Examiner*—C. T. Bartz
*Attorney, Agent, or Firm*—Kenyon & Kenyon

[57] ABSTRACT

An attachment of a fuel injection valve is formed at least from the main body and the insert which bound the gas supply passages between them and direct the gas in a metered and targeted manner onto the sprayed fuel. The attachment makes it possible to separate the functions of gas supply and metering from those of sealing the fuel injection valve against an induction conduit and fastening the attachment on the fuel injection valve. Furthermore, the design configuration results in a large number of variants which can be achieved by very simple and low-cost exchangeability of parts by virtue of the modularity of the system. The fuel injection valve is particularly suitable for fuel injection systems of mixture compressing internal combustion engines with external ignition supply.

10 Claims, 2 Drawing Sheets

FUEL INJECTION VALVE

FIELD OF THE INVENTION

The present invention relates to a fuel injection valve.

BACKGROUND INFORMATION

An electromagnetically actuated valve for injecting a fuel/air mixture into a mixture-compressing internal combustion engine with externally supplied ignition is described in U.S. Pat. No. 4,957,241. In this valve, a distance plate is installed between a nozzle body and a protective cap in order to influence the air quantity. The distance plate between the nozzle body and the protective cap has a central opening into which the downstream pintle end of a valve needle is inserted. The air supply to the fuel emerging from a fuel passage takes place in an untargeted manner via air passages and air chambers. The radial air supply to the valve needle pintle is determined by the height of distance knobs and takes place around the whole of the fuel jet. However, the quantity and the composition of the fuel/air mixture is ultimately determined by the size of the annular gap extending in the axial direction between the valve needle pintle and the periphery of the opening in the distance plate.

U.S. Pat. No. 4,982,716 describes injection valves provided with an adapter, in which air supply passages are configured, at the downstream end. An impingement surface is provided in the adapter downstream of a single spray opening. The sprayed fuel jet meets this impingement surface and is guided in film form into two spray passages, air from the air supply passages being directed in a targeted manner onto the fuel films formed after the impingement. In this arrangement, the functions of air supply or metering and fastening to the injection valve are achieved jointly so that the two functions can scarcely be achieved in an optimum manner because of the integration.

Furthermore, the arrangement of an attachment downstream of a valve seat is known from German Patent Application No. 41 08 279. The column of fuel emerging from a nozzle passes directly into an atomization orifice of the attachment where it is surrounded and prepared by air flowing out of auxiliary air passages introduced into the side walls.

SUMMARY OF THE INVENTION

The fuel injection valve according to the present invention has the advantage that very good atomization of the fuel is achieved by a targeted gas supply in a very simple and low-cost manner. This is possible by means of a low-cost attachment which can be very easily fitted to and removed from the fuel injection valve. Furthermore, the multi-part design configuration of the attachment provides a large number of variants which permit the gas throughput and the jet direction of the fuel to be influenced in a very rapid and simple manner.

It is particularly advantageous for the attachment to be configured in three parts, namely a tubular main body, an insert which can be inserted in the main body, and a ring spring. Whereas the main body is used for providing a seal between the fuel injection valve and an induction conduit and for fastening the attachment to the fuel injection valve, the insert is mainly responsible for the gas supply and metering. A jet splitter, which maintains or reinforces the provision of twin jets by the fuel injection valve, can also be provided in an advantageous manner in the main body.

In order to ensure that the insert is unambiguously located in the main body, it is useful for the insert to have at least one guide protrusion which engages in an axial slot in the main body. A large number of variants can be very simply achieved because only the inserts are changed to satisfy different specific applications whereas the main body can be used for many applications. A modular system is therefore present. Removal of the attachment from the fuel injection valve is easily possible at any time because the fastening is easily manipulated.

It is advantageous to use a ring spring for fastening the attachment onto the fuel injection valve. This ring spring radially clamps the main body of the attachment so that the latter cannot slip, even in the case of strong vibrations, because there is also an additional snap-in connection on the fuel injection valve. In this arrangement, the ring spring does not have to be fully peripheral but can be configured as an open spring ring.

Further advantages arise from the employment of "tailor-made" plastics for the different components. Various plastics can be provided for the main body and the insert to suit different application purposes.

DETAILED DESCRIPTION

Figure 1:
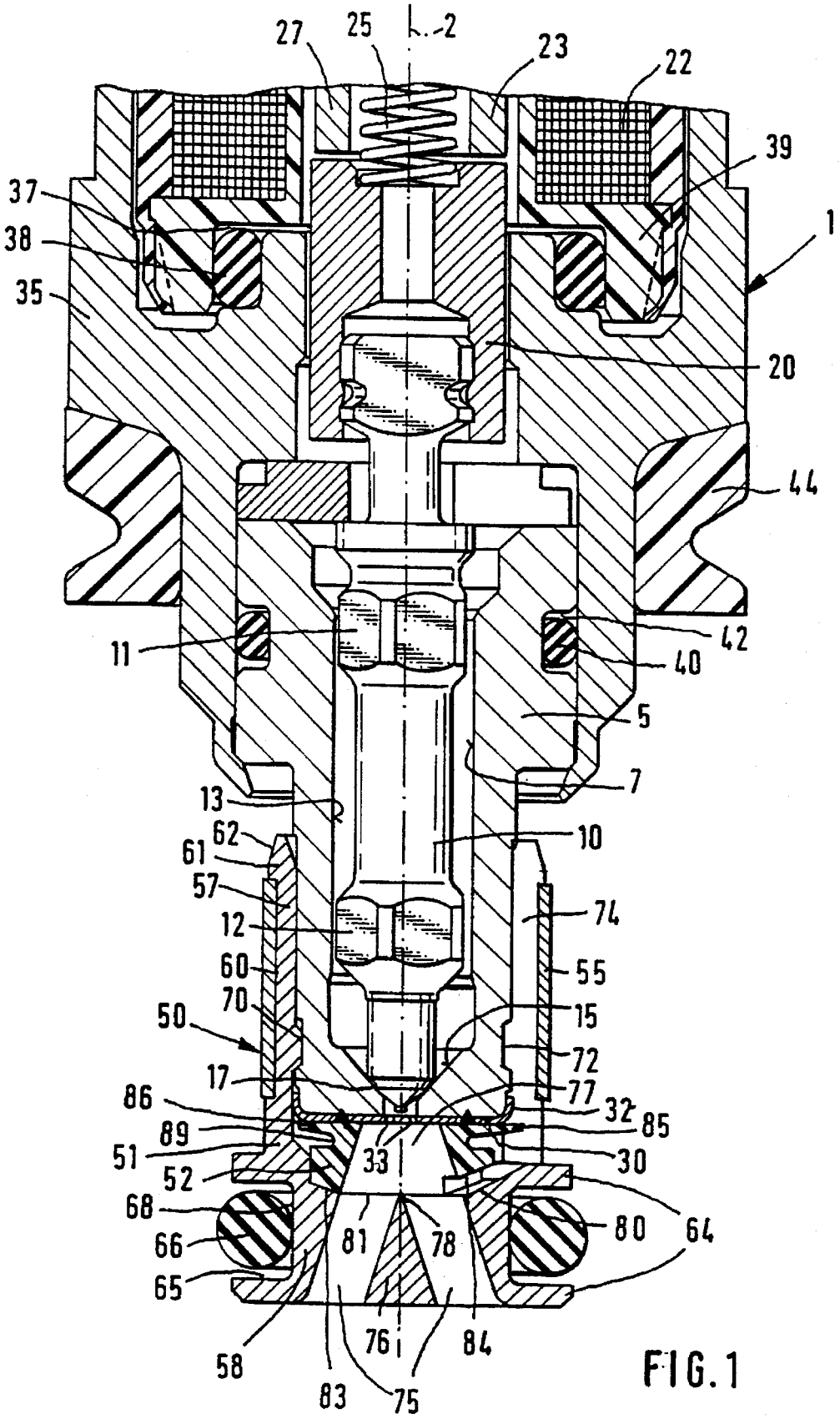
FIG. 1 shows a partial cross-sectional side view of the fuel injection valve according to the present invention.

A valve, in the form of a fuel injection valve for fuel injection systems of mixture-compressing internal combustion engines with externally supplied ignition, is represented in an exemplary embodiment in FIG. 1. Together with an attachment according to the present invention, the fuel injection valve is used for injecting a fuel/gas (fuel/air) mixture into an induction pipe of the internal combustion engine or for injecting directly into its combustion space. The fuel injection valve 1, which, for example, can be actuated electromagnetically, extends concentrically along a valve longitudinal center line 2.

As part of a valve housing, the fuel injection valve 1 has a nozzle body 5 which extends at its downstream end. A stepped longitudinal hole 7 is formed in the nozzle body 5. This hole extends concentrically with the valve longitudinal center line 2 and in it is arranged a valve closing part 10 which is, for example, needle-shaped. The valve closing part 10 has, for example, two guide sections 11, 12 which together with a guide region 13 of the wall of the longitudinal hole 7 in the nozzle body 5, are used for guiding the valve closing part 10. At its downstream end, the longitudinal hole 7 of the nozzle body 5 has a fixed valve seat 15, which tapers in the shape of a truncated cone in the direction of the fuel flow. In conjunction with a sealing section 17 of the valve closing part 10, this valve seat 15 forms a seat valve. This sealing section 17 tapers in the shape of a truncated cone in the fuel flow direction.

At its end facing away from the sealing section 17, the valve closing part 10 is connected to a tubular armature 20 which interacts with a magnet coil 22 partially surrounding the armature 20 in the axial direction and with a tubular core 23 of the fuel injection valve 1 located opposite to the armature 20 in the direction facing away from the fixed valve seat 15. One end of a return spring 25 is in contact with that end of the valve closing part 10 which is connected to the armature 20, and this return spring tends to move the valve closing part 10 in the direction of the fixed valve seat 15. The other end of the return spring 25 is supported on an adjusting sleeve 27 which is, for example, non-magnetic.

A spray orifice plate 32 rests on an end surface 30, facing away from the core 23, of the nozzle body 5 of the fuel injection valve 1, and this spray orifice plate is firmly connected to the nozzle body 5 by, for example, a weld seam produced by means of laser welding. The spray orifice plate 32 has, for example, four spray openings 33 through which the fuel flowing past the valve seat 15 is sprayed when the valve closing part 10 is lifted.

A recess 37 is formed in the axial extent region of the armature 20 on, for example, the periphery of a valve casing 35 of the fuel injection valve 1, which casing is likewise part of the valve housing. An upper sealing ring 38, which is used for sealing a stepped coil body 39 (which surrounds the magnet coil 22) against the fuel, is arranged in the recess 37. A second sealing ring 40 in a groove introduced into the periphery of the nozzle body 5 ensures the sealing between the nozzle body 5 and the valve casing 35. A sealing element 44 on the periphery of the valve casing 35 is used for sealing between the periphery of the injection valve and a valve receptacle (not shown).

A plastic attachment 50 is provided at the downstream end for the supply and metering of a gas which is used for improved preparation and atomization of the fuel. Induction air branched off through a bypass before a throttle butterfly in an induction pipe of the internal combustion engine, air delivered by an auxiliary blower, and even recirculated internal combustion engine exhaust gas or a mixture of air and exhaust gas, for example, can be used as the gas. The use of recirculated exhaust gas permits a reduction in the pollutant emission from the internal combustion engine. The supply of the gas as far as the attachment 50 is not represented in any more detail.

The attachment 50 is configured in three-parts. An at least partially tubular main body 51 radially surrounds the downstream end of the nozzle body 5 and is fastened to the latter by, for example, a snap-in arrangement. The main body 51 continues to extend in the axial direction downstream of the spray orifice plate 32. In the installed condition, an insert 52, which can be inserted in the main body 51, is arranged immediately downstream of the spray orifice plate 32. The insert 52 is configured in such a way that a gas coming from outside the attachment 50 can flow into the attachment 50 between the insert 52 and the main body 51. Complete and secure fixing of the attachment 50 onto the nozzle body 5 of the fuel injection valve 1 is ensured by a ring spring 55 whose radial spring force presses a part of the main body 51 against the nozzle body 5. The ring spring 55 can, for example, be a spring ring which is not completely closed.

The main body 51 of the attachment 50 is, in turn, composed of an upstream support section 57 and a downstream jet-splitting section 58. The support section 57 is used for fastening the attachment 50 to the nozzle body 5, because it radially surrounds the downstream end of the nozzle body 5, and is used for supplying gas from outside the attachment 50 in the direction of the insert 52. A peripheral groove 60, which can accommodate the ring spring 55, is provided on the outer contour of the tubular support section 57 and is, for example, formed over the major portion of the axial extent of the support section 57. Away from the groove 60, the support section 57 has a substantially constant outer diameter; chamfers 62 can be introduced at its upper end 61 in order to facilitate the fitting of the attachment 50. In contrast, the jet-splitting section 58 has three annular regions of different outer diameters extending concentrically with the valve longitudinal center line 2 and following one another in axial sequence.

Two annular regions 64 protruding to the same extent beyond the support section 57 are used to form an annular groove 65. A sealing ring 66 can be inserted in this groove 65 to seal between the periphery of the injection valve and a receptacle (not shown) for the valve, for example the induction pipe of the internal combustion engine. The annular groove 65 is bounded axially by the two annular regions 64 and radially by the groove bottom 68, whose diameter is smaller than the outer diameter of the support section 57 but is, for example, the same size as the diameter of the inner wall of the tubular support section 57.

The whole of the main body 51 is fastened on the fuel injection valve 1, in particular on the nozzle body 5, by a bead 70 which is formed around the support section 57 and extends radially from the inner wall in the direction of the valve longitudinal center line 2. The height of the bead 70 is small and it snaps into a peripheral groove 72 on the nozzle body 5. This snap-in connection does not in itself completely secure the main body 51 against slipping, particularly in the case of strong vibrations. Furthermore, the snap-in connection does not secure against rotation. The ring spring 55 arranged in the groove 60 of the support section 57 is therefore used to provide complete secure fixing of the main body 51 on the nozzle body 5.

In order to make the support section 57 sufficiently flexible, at least one slot 74 is provided therein which extends axially over the complete length of the support section 57, i.e. from the upper end 61 to the upper of the two annular regions 64. This at least one slot 74 in the support section 57 makes it possible to splay out the support section 57 when it is being fitted onto the nozzle body 5, and it therefore ensures simplified manipulation. Two slots 74 introduced opposite to one another in the support section 57 are also conceivable. In addition to improving assembly, the at least one slot 74 is used as an opening in the support section 57 for the supply of the gas in the direction of the insert 52.

In its jet-splitting section 58, the main body 51 is configured with two holes 75 which extend obliquely to the valve longitudinal center line 2. They diverge in the downstream direction and the fuel/gas mixture is sprayed through them. The material remaining between the two holes 75 necessarily acts as a jet splitter 76. Because the holes 75, which start from a spray space 77 located in the insert 52, extend immediately downstream of the spray orifice plate 32, the jet splitter 76 has a pointed tip 78 which is directed towards the spray orifice plate 32 whereas, starting from the tip 78, the jet splitter 76 becomes wider in cross-section in the downstream direction. The twin-jet nature of the spray, which has been generated by the spray openings 33 in the spray orifice plate 32 and which is, for example, required for the injection of fuel in the direction of two inlet valves—but whose twin-jet nature can be impaired by the intermediate supply of gas—is therefore retained or is reinforced by the jet splitter 76 and the two holes 75.

The insert 52 is accommodated in a depression 80 provided for it in the main body 51. This depression 80 extends in the axial region of the upper annular region 64 and is centrally arranged. A depression bottom 81, which bounds the depression 80 in the downstream direction, for example, is formed where the spray space 77 ends within the insert 52 and where the holes 75 begin and the tip 78 is located. It is, furthermore, possible to configure the holes 75 in such a way that the tip 78 of the jet splitter 76 protrudes into the spray space 77, i.e. is further upstream than the depression bottom 81, so that the gas flowing in through a gas supply passage 84, which is arranged on an end surface 83 facing towards the depression 80 of the main body 51 passes exactly into a hole 75. The insert 52 Abbey designed in such a way that its outer contour, or at least the end surface 83 which faces away from the spray orifice plate 32 and which is placed directly into the depression 80, fits accurately into this depression 80.

In addition to the depression bottom 81, the depression 80 has surfaces of different obliquity radially outside the holes 75. By means of these surfaces, a defined installation position of the insert 52 is achieved and the gas supply is ensured at, for example, two regions.

Specifically, into the insert 52 two gas supply passages 84 with trapezoidal cross-sections, for example, are introduced on its lower end surface in its lower part facing away from the spray orifice plate 32. These gas supply passages are open towards the jet-splitting section 58 of the main body 51 but, in the installed condition of the insert 52, are also bounded by the chamfered surfaces of the depression 80. The completely surrounded gas supply passages 84 thus represent inflow spaces for the gas. Because of the configuration of the gas supply passages 84, the gas entering the spray space 77 through the inlet spaces impinges substantially perpendicularly on the fuel sprayed from the spray openings 33. The inner spray space 77, with substantially the shape of a truncated cone, is configured in such a way that, near the spray orifice plate 32, it has a slightly elliptical cross-section of such a size that the fuel from the spray openings 33 can enter unhindered, and at its other end, i.e. in the region of the depression bottom 81, has a cross-section such that a stepless transition takes place to the holes 75 and that, therefore, no masking, which would reduce the cross section of the holes 75, occurs. The inclination of the spray space 77 wall with substantially the shape of a truncated cone is, for example, identical to those of the diverging holes 75.

One or two (for example) guide protrusions 85, which are used to ensure the correct installation position of the insert 52, extend radially outwards from the inner spray space 77 immediately downstream of the spray orifice plate 32. In the assembled condition, the at least one guide protrusion 85 engages radially in the at least one axial slot 74 of the support section 57 so that the installation position is precisely defined, and slipping of the insert 52 relative to the main body 51 can be excluded by the rotational lock. The at least one guide protrusion 85 extends in the radial direction beyond at least one annular region 86. The annular region 86 exerts a spring effect because it can be moved axially to a small extent due to a peripheral and groove-shaped recess 89 located immediately downstream. Compensation can therefore be provided easily for small axial tolerances. In the installed condition, the upper end surface of the insert 52 including also the region 86 and, in part, the at least one guide protrusion 85—is in sprung contact with the spray orifice plate 32. After the attachment 50 has been fitted to the fuel injection valve 1, there is accurately defined metering geometry present. Because of the very simple fitting and removal of the attachment 5, the gas throughput and the jet direction of the fuel can be influenced in a simple and low-cost manner, for example by using different inserts 52.

Figure 2:
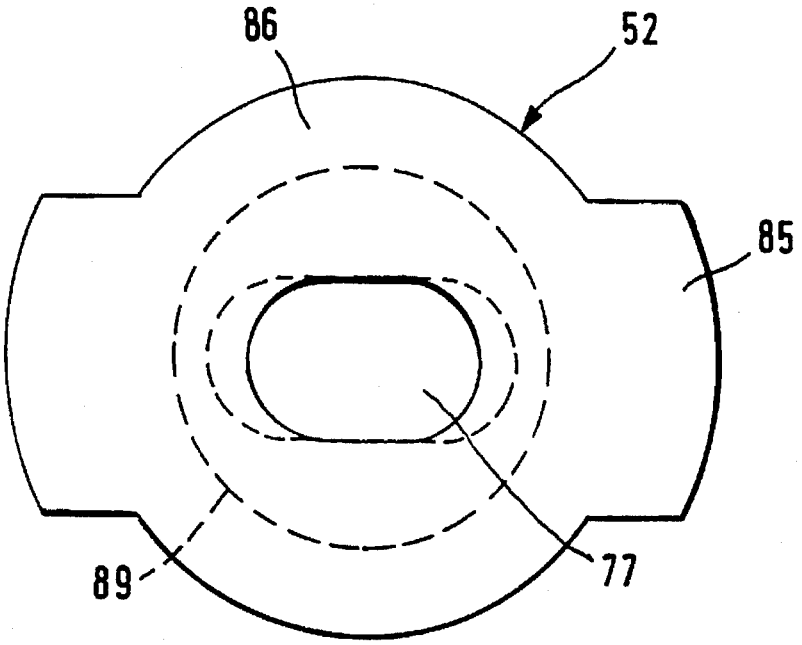
FIG. 2 shows a top view of the insert of the fuel injection valve shown in FIG. 1, according to the present invention.

FIG. 2 represents a top view onto the insert 52. This illustrates how the two guide protrusions 85, which engage in the slots 74 of the support section 57, protrude radially beyond the region 86 that exhibits an axial spring effect. The guide protrusions 85 are configured with a width which corresponds to the width of the slots 74.

Figure 3:
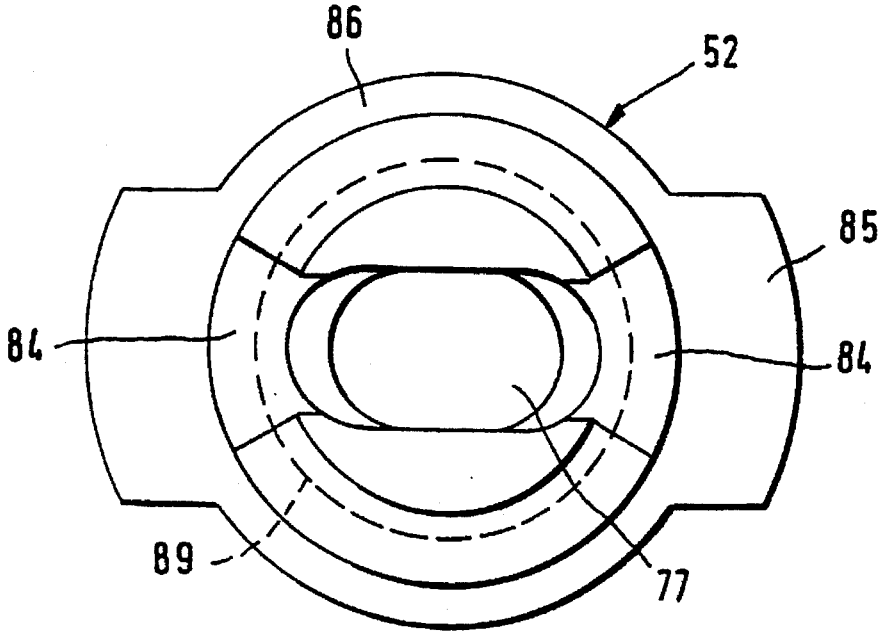
FIG. 3 shows a bottom view of the insert of the fuel injection valve shown in FIG. 1, according to the present invention.

The two gas supply passages 84 can be recognized in more detail in FIG. 3, which shows a bottom view onto the insert 52. The gas supply passages 84 are arranged centrally relative to the guide protrusions 85 so that the gas flows in underneath the guide protrusions 85 through the slots 74 and then passes directly into the gas supply passages 84. The flow cross-section for the gas in the inlet spaces tapers from the outer periphery to the spray space 77, with the result that the gas is strongly accelerated, and the fuel which emerges from the spray openings 33 and flows axially through the insert 52, on which fuel the gas impinges substantially perpendicularly, is particularly finely atomized. The gas supply passages 84 can extend at right angles to the valve longitudinal center line 2 or inclined in the flow direction of the fuel.

What is claimed is:

1. A fuel injection valve for injecting fuel to an internal combustion engine, the valve having a longitudinal axis and a downstream end, comprising:

a movable valve closing body;

a nozzle body including a valve seat, the valve seat interacting with the valve closing body, at least one spray opening being disposed downstream of the valve seat; and an attachment arranged at the downstream end of the valve, the attachment having at least one means for supplying a gas, the attachment including an axially extending tubular main body and an insert adapted to be inserted in a depression of the main body, the insert having an inner spray space downstream of the at least one spray opening, the insert including an end surface providing at least one gas supply passage facing towards the depression of the main body, the gas supply passage extending from an outer periphery of the insert to the inner spray space, the gas supply passage being bounded by the main body.

2. The valve according to claim 1, wherein the main body and the insert are composed of a plastic.

3. The valve according to claim 1, further comprising a jet splitter arranged in the main body downstream of the insert.

4. The valve according to claim 1, wherein the main body radially surrounds the nozzle body, and the main body is pressed at least partially against the nozzle body by a ring spring.

5. The valve according to claim 1, wherein the insert is adapted to be placed as a form fit in the depression of the main body.

6. The valve according to claim 1, wherein the insert has an axially sprung region in contact with the downstream end of the valve.

7. The valve according to claim 6, further comprising at least one guide protrusion elevated radially from the axially sprung region of the insert, the guide protrusion being for positionally fixing the insert relative to the main body.

8. The valve according to claim 1, wherein the gas supply passage tapers from the outer periphery of the insert toward the longitudinal axis of the valve.

9. The valve according to claim 1, wherein the spray space is elliptical in cross-section and extends in an axial direction in a truncated cone shape.

10. The valve according to claim 1, wherein a fuel/gas mixture emerges from the attachment.

* * * * *